US010854127B2

(12) United States Patent
You

(10) Patent No.: US 10,854,127 B2
(45) Date of Patent: Dec. 1, 2020

(54) GAMMA VOLTAGE GENERATOR AND DISPLAY DEVICE INCLUDING THE SAME

(71) Applicant: Samsung Display Co., Ltd., Yongin-si (KR)

(72) Inventor: Jinyoung You, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/709,724

(22) Filed: Dec. 10, 2019

(65) Prior Publication Data

US 2020/0312215 A1 Oct. 1, 2020

(30) Foreign Application Priority Data

Mar. 29, 2019 (KR) ..... 10-2019-0037109

(51) Int. Cl.
*G09G 3/20* (2006.01)

(52) U.S. Cl.
CPC ..... *G09G 3/2011* (2013.01); *G09G 3/2003* (2013.01); *G09G 2310/027* (2013.01); *G09G 2310/0267* (2013.01); *G09G 2310/08* (2013.01); *G09G 2320/0673* (2013.01); *G09G 2330/028* (2013.01)

(58) Field of Classification Search
CPC ..... G09G 3/2077–2081; G09G 2300/0443; G09G 2320/0276; G09G 2320/0673
See application file for complete search history.

(56) References Cited

U.S. PATENT DOCUMENTS 7,973,690 B1 * 7/2011 Weng ..... H03M 1/664 341/144
8,780,568 B2 7/2014 Osako et al.
2005/0007393 A1 * 1/2005 Akai ..... G09G 3/3291 345/690

(Continued)

FOREIGN PATENT DOCUMENTS

JP 4306763 B2 8/2009
KR 10-2009-0068342 A 6/2009

(Continued)

*Primary Examiner* — Sanghyuk Park
(74) *Attorney, Agent, or Firm* — Lewis Roca Rothgerber Christie LLP

(57) ABSTRACT

A gamma voltage generator includes a reference gamma selecting circuit that receives first and second reference voltages and selects an upper reference gamma voltage (e.g., corresponding to a maximum gamma tab voltage among voltages between the first and second reference voltages) and a lower reference gamma voltage (e.g., corresponding to a minimum gamma tab voltage among the voltages) based on a dimming level, a bias control circuit that calculates the minimum gamma tab voltage based on the upper and lower reference gamma voltages and outputs bias control signals when the minimum gamma tab voltage is less than a reference voltage, a gamma tab voltage generating circuit that generates gamma tab voltages between the minimum and maximum gamma tab voltages based on the upper and lower reference gamma voltages, and a gamma output circuit that distributes the gamma tab voltages to output gamma voltages corresponding to a gamma curve.

20 Claims, 5 Drawing Sheets

(56) References Cited

U.S. PATENT DOCUMENTS

| | | | | |
|---|---|---|---|---|
| 2005/0168416 | A1* | 8/2005 | Hashimoto | G09G 3/3291 345/76 |
| 2005/0168418 | A1* | 8/2005 | Seo | G09G 3/3275 345/76 |
| 2008/0180379 | A1* | 7/2008 | Takahashi | G09G 3/3688 345/98 |
| 2010/0123738 | A1* | 5/2010 | Matsukawa | G09G 3/3648 345/690 |
| 2010/0165002 | A1* | 7/2010 | Ahn | G09G 3/3648 345/690 |
| 2017/0053581 | A1* | 2/2017 | Jung | G09G 5/10 |
| 2020/0152134 | A1* | 5/2020 | Lee | G09G 3/2074 |

FOREIGN PATENT DOCUMENTS

| | | | |
|---|---|---|---|
| KR | 10-2013-0108822 | A | 10/2013 |
| KR | 10-2015-0027925 | A | 3/2015 |

* cited by examiner

GAMMA VOLTAGE GENERATOR AND DISPLAY DEVICE INCLUDING THE SAME

CROSS-REFERENCE TO RELATED APPLICATION(S)

This application claims priority to, and the benefit of, Korean Patent Application No. 10-2019-0037109, filed on Mar. 29, 2019 in the Korean Intellectual Property Office (KIPO), the contents of which are incorporated herein in its entirety by reference.

BACKGROUND

1. Field

Embodiments disclosed herein relate generally to a gamma voltage generator, and to a display device including the gamma voltage generating device.

2. Description of the Related Art

Recently, various flat panel display devices capable of reducing weight and volume, which are disadvantages associated with a cathode ray tube (CRT) device, have been developed. Such flat display devices include a liquid crystal display (LCD) device, a field emission display (FED) device, a plasma display panel (PDP) device, and an organic light emitting display (OLED) device, etc.

Generally, a display device includes a display panel, and a display panel driving circuit. The display panel includes a plurality of pixels. The display panel driving circuit includes a scan driver that provides a scan signal to the pixels, and includes a data driver that provides a data signal to the pixels. The data driver converts image data that is in a digital form into a data signal that is in an analog form based on gamma voltages that are output from a gamma voltage generator, where the image data is input from a timing controller.

The gamma voltage output from the gamma voltage generator may include a noise component. For example, when the gamma voltage generator has a cascade structure, a noise of a low gray-level gamma voltage that is output from the gamma voltage generator may be increased/may be dominant.

SUMMARY

Some embodiments provide a gamma voltage generator that can reduce noises of gamma voltages and power consumption of a display device. Some embodiments provide a display device including the gamma voltage generator.

According to embodiments disclosed herein, a gamma voltage generator may include a reference gamma selecting circuit configured to receive a first reference voltage, and a second reference voltage that is higher than the first reference voltage, and select an upper reference gamma voltage and a lower reference gamma voltage based on a dimming level, the upper reference gamma voltage corresponding to a maximum gamma tab voltage among voltages between the first reference voltage and the second reference voltage, and the lower reference gamma voltage corresponding to a minimum gamma tab voltage among the voltages between the first reference voltage and the second reference voltage, a bias control circuit configured to calculate the minimum gamma tab voltage based on the upper reference gamma voltage and the lower reference gamma voltage, and output bias control signals when the minimum gamma tab voltage is less than a reference voltage, a gamma tab voltage generating circuit configured to generate a plurality of gamma tab voltages between the minimum gamma tab voltage and the maximum gamma tab voltage based on the upper reference gamma voltage and the lower reference gamma voltage, and a gamma output circuit configured to distribute the gamma tab voltages to output gamma voltages corresponding to a gamma curve.

The gamma tab voltage generating circuit may be configured to control output strengths of the gamma tab voltages based on the bias control signals.

The gamma tab voltage generating circuit may be configured to differently control output strengths of the gamma tab voltages based on the bias control signals.

The gamma tab voltage generating circuit may be configured to control an output strength of one of the gamma tab voltages corresponding to a lower gray-level to be stronger than an output strength of another one of the gamma tab voltages corresponding to an upper gray-level based on the bias control signals.

The gamma tab voltage generating circuit may include a plurality of resistor-strings connected in a cascade form to distribute the upper reference gamma voltage and the lower reference gamma voltage, a plurality of gamma tap selectors configured to select a portion of distributed voltages that are generated by the resistor-strings as the gamma tab voltages based on a plurality of gamma tap selection signals, and a plurality of gamma amplifiers configured to control output strengths of the gamma tab voltages based on the bias control signals.

The bias control signals may be configured to respectively control a bias current for each of the gamma amplifiers.

The bias current for one of the gamma amplifiers that outputs the one of the gamma tab voltages corresponding to a lower gray-level may be greater than the bias current for another one of the gamma amplifiers that outputs the other one of the gamma tab voltages corresponding to an upper gray-level among the gamma tab voltages.

The reference gamma selecting circuit may include a reference resistor-string configured to distribute the first reference voltage and the second reference voltage, a first reference selector configured to select one of distributed voltages generated by the reference resistor-string as the lower reference gamma voltage based on the dimming level, and a second reference selector configured to select one of the distributed voltages generated by the reference resistor-string as the upper reference gamma voltage based on the dimming level.

The reference gamma selecting circuit may be configured to increase the upper reference gamma voltage as the dimming level increases.

According to embodiments of the present disclosure, a display device may include a display panel including a plurality of pixels, a gamma voltage generator configured to output a plurality of gamma voltages, a data driver configured to generate a data signal based on the gamma voltages, and to provide the data signal to the pixels, a scan driver configured to provide a scan signal to the pixels, and a timing controller configured to control the gamma voltage generator, the data driver, and the scan driver, wherein the gamma voltage generator includes a reference gamma selecting circuit configured to receive a first reference voltage, and a second reference voltage that is higher than the first reference voltage, and to select an upper reference gamma voltage and a lower reference gamma voltage based on a dimming level, the upper reference gamma voltage corresponding to a maximum gamma tab voltage among voltages between the first reference voltage and the second reference voltage, and the lower reference gamma voltage corresponding to a minimum gamma tab voltage among the voltages between the first reference voltage and the second reference voltage, a bias control circuit configured to calculate the minimum gamma tab voltage based on the upper reference gamma voltage and the lower reference gamma voltage, and to output bias control signals when the minimum gamma tab voltage is less than a reference voltage, a gamma tab voltage generating circuit configured to generate a plurality of gamma tab voltages between the minimum gamma tab voltage and the maximum gamma tab voltage based on the upper reference gamma voltage and the lower reference gamma voltage, and a gamma output circuit configured to distribute the gamma tab voltages to output gamma voltages corresponding to a gamma curve.

The gamma tab voltage generating circuit may be configured to control output strengths of the gamma tab voltages based on the bias control signals.

The gamma tab voltage generating circuit may be configured to differently control output strengths of the gamma tab voltages based on the bias control signals.

The gamma tab voltage generating circuit may be configured to control an output strength of the gamma tab voltage corresponding to a lower gray-level among the gamma tab voltages to be stronger than an output strength of the gamma tab voltage corresponding to an upper gray-level among the gamma tab voltages based on the bias control signals.

The gamma tab voltage generating circuit may include a plurality of resistor-strings connected in a cascade form to distribute the upper reference gamma voltage and the lower reference gamma voltage, a plurality of gamma tap selectors configured to select a portion of distributed voltages generated by the resistor-strings as the gamma tab voltages based on a plurality of gamma tap selection signals, and a plurality of gamma amplifiers configured to control output strengths of the gamma tab voltages based on the bias control signals.

Each of the bias control signals may be configured to control a bias current for each of the gamma amplifiers.

The bias current for one of the gamma amplifiers that outputs one of the gamma tab voltages corresponding to a lower gray-level may be greater than the bias current for another one of the gamma amplifiers that outputs another one of the gamma tab voltages corresponding to an upper gray-level.

The reference gamma selecting circuit may include a reference resistor-string configured to distribute the first reference voltage and the second reference voltage, a first reference selector configured to select one of distributed voltages generated by the reference resistor-string as the lower reference gamma voltage based on the dimming level, and a second reference selector configured to select one of the distributed voltages generated by the reference resistor-string as the upper reference gamma voltage based on the dimming level.

The reference gamma selecting circuit may be configured to increase the upper reference gamma voltage as the dimming level increases.

The gamma voltage generator may be configured to generate red color gamma voltages, green color gamma voltages, and blue color gamma voltages, respectively.

The gamma voltage generator may be connected to the data driver, or is included within the data driver.

Accordingly, a gamma voltage generator, and a display device including the gamma voltage generator, according to the disclosed embodiments may reduce noises of gamma voltages, and may reduce power consumption of the display device, by calculating a minimum gamma tab voltage based on an upper reference gamma voltage and a lower reference gamma voltage, by outputting bias control signals when the minimum gamma tab voltage is less than a reference voltage (e.g., a predetermined reference voltage), and by differently controlling output strengths of gamma tab voltages based on the bias control signals.

BRIEF DESCRIPTION OF THE DRAWINGS

Illustrative, non-limiting embodiments will be more clearly understood from the following detailed description in conjunction with the accompanying drawings.

DETAILED DESCRIPTION

Figure 1:
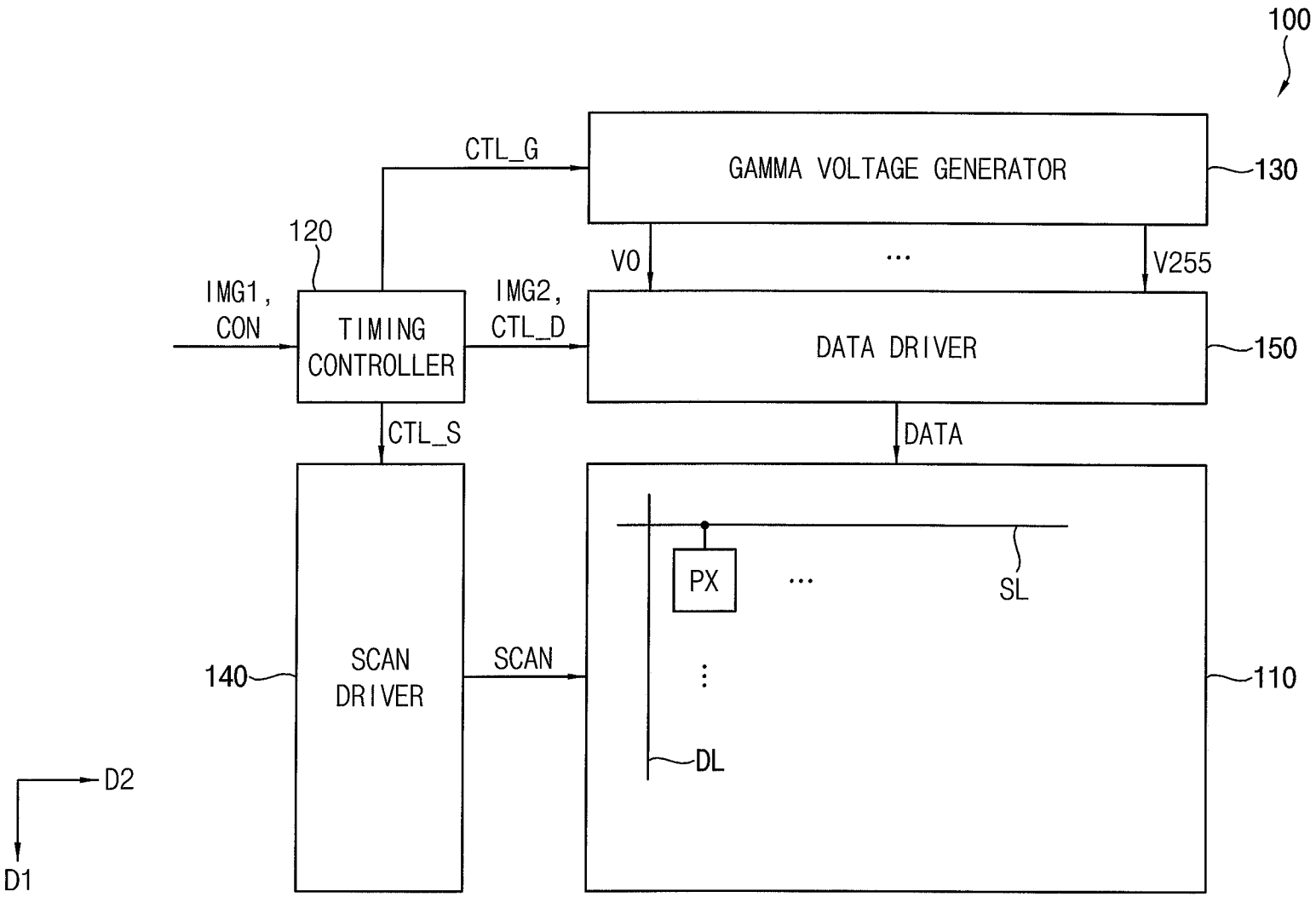
FIG. 1 is a block diagram illustrating a display device according to embodiments.

Features of embodiments of the present disclosure, and methods of accomplishing the same, may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described.

Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (e.g., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which embodiments of the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to embodiments.

Referring to FIG. 1, the display device 100 may include a display panel 110, a timing controller 120, a gamma voltage generator 130, a scan driver 140, and a data driver 150.

The display panel 110 may include a plurality of pixels PX. In an embodiment, each of the pixels PX may include a red color sub-pixel PX, a green color sub-pixel PX, and a blue color sub-pixel PX. The display panel 110 may include data lines DL and scan lines SL that are connected to the pixels PX. The data lines DL may extend in a first direction D1, and may be arranged in a second direction D2 that is substantially perpendicular to the first direction D1. The scan lines SL may extend in the second direction D2, and may be arranged in the first direction D1. For example, the first direction D1 may be substantially parallel to a short side of the display panel 110, and the second direction D2 may be substantially parallel to a long side of the display panel 110. The pixels PX may be respectively formed at regions where the data lines DL and the scan lines SL crossed. Each of the pixels PX may emit light based on a data signal DATA that is provided via the date lines DL in response to a scan signal SCAN that is provided via the scan lines SL.

The timing controller 120 may receive first image data IMG1 and a control signal CON from an external device. The timing controller 120 may convert the first image data IMG1 into second image data IMG2. The timing controller 120 may convert the first image data IMG1 into the second image data IMG2 by applying an algorithm for correcting an image quality to the first image data IMG1, and may provide the second image data IMG2 to the data driver 150. The timing controller 120 may generate a scan control signal CTL_S and a data control signal CTL_D for controlling a driving timing of the second image data IMG2 based on the control signal CON. For example, the scan control signal CTL_S may include a vertical start signal and at least one scan clock signal, and the data control signal CTL_D may include a horizontal start signal and a horizontal synchronization signal. The timing controller 120 may provide the scan control signal CTL_S to the scan driver 140, and may provide the data control signal CTL_D to the data driver 150. In addition, when changing a dimming level according to a user's input or to an external input, the timing controller 120 may provide a gamma control signal CTL_G to the gamma voltage generator 130 to change a gamma curve. For example, the gamma control signal CTL_G may include the dimming level that is input from a user or an external component.

The gamma voltage generator 130 may receive a first reference voltage, and may also receive a second reference voltage that is higher than the first reference voltage. Based on the gamma control signal CTL_G (e.g., the dimming level), the gamma voltage generator 130 may select an upper reference gamma voltage corresponding to a maximum gamma tab voltage among voltages between the first reference voltage and the second reference voltage, and may also select a lower reference gamma voltage corresponding to a minimum gamma tab voltage among the voltages between the first reference voltage and the second reference voltage. For example, the gamma voltage generator 130 may increase the upper reference gamma voltage (e.g., may select the upper reference gamma voltage having a higher voltage level) as the dimming level increases.

The gamma voltage generator 130 may calculate the minimum gamma tab voltage based on the upper reference gamma voltage and the lower reference gamma voltage, and may output bias control signals when the minimum gamma tab voltage is less than a reference voltage (e.g., a predetermined reference voltage). The gamma voltage generator 130 may generate a plurality of gamma tab voltages between the minimum gamma tab voltage and the maximum gamma tab voltage based on the upper reference gamma voltage and the lower reference gamma voltage. Here, the gamma voltage generator 130 may control output strengths of the gamma tab voltages based on the bias control signals.

The gamma voltage generator 130 may differently control the output strengths of the gamma tab voltages based on the bias control signals. Thus, the output strengths of the gamma tab voltages may be different from each other. For example, the gamma voltage generator 130 may control an output strength of one of the gamma tab voltages that corresponds to a lower gray-level to be stronger than an output strength of one of the gamma tab voltages corresponding to an upper gray-level based on the bias control signals.

The gamma voltage generator 130 may include gamma amplifiers that control the output strengths of the gamma tab voltages based on the bias control signals. Each of the bias control signals may control a bias current for each of the gamma amplifiers. For example, the gamma voltage generator 130 may reduce a noise of the gamma tab voltage by increasing the output strength of the gamma amplifier by increasing the bias current for the gamma amplifier that outputs the gamma tab voltage corresponding to the lower gray-level. In addition, the gamma voltage generator 130 may reduce power consumption of the display device 100 by decreasing the output strength of the gamma amplifier by decreasing the bias current for the gamma amplifier that outputs the gamma tab voltage corresponding to the upper gray-level.

The gamma voltage generator 130 may output gamma voltages V0 through V255 corresponding to a gamma curve by distributing the gamma tab voltages. The gamma voltage generator 130 may output red color gamma voltages for generating data voltages provided to red color sub-pixels PX, green color gamma voltages for generating data voltages provided to green color sub-pixels PX, and blue color gamma voltages for generating data voltages provided to blue color sub-pixels PX, respectively. The gamma voltage generator 130 will be described in detail with reference to FIGS. 3 and 4.

The scan driver 140 may generate the scan signal SCAN provided to the pixels PX. The scan driver 140 may generate the scan signal SCAN based on the scan control signal CTL_S provided from the timing controller 120, and may provide the scan signal SCAN to the scan lines SL in the display panel 110. In an embodiment, the scan driver 140 may be formed substantially simultaneously with transistors of the pixels PX and may be located or mounted on the display panel 110 as an amorphous silicon TFT gate driver circuit (ASG) or as an oxide silicon TFT gate driver (OSG) circuit. In another embodiment, the scan driver 140 may be formed to include a plurality of driving chips, and may be located at a non-display region of the display panel 110 in a chip on glass (COG) manner. In still another embodiment, the scan driver 140 may be formed to include a plurality of driving chips, may be located on a flexible printed circuit board (FPCB), and may be connected to the display panel 110 in a chip on film (COF) manner.

The data driver 150 may generate the data signal DATA based on the gamma voltages provided from the gamma voltage generator 130, and also based on the second image data IMG2 and the data control signal CTL_D provided from the timing controller 120. The data driver 150 may convert the second image data IMG2, which is digital image data, into analog image data using the gamma voltages, and may generate the data signal DATA based on the analog image data. The data driver 150 may provide the data signal DATA to the data lines DL in the display panel 110 based on the data control signal CTL_D. In an embodiment, the data driver 150 may be implemented as a chip on film (COF) that includes a plurality of driving chips and a flexible printed circuit board (FPCB) on which the driving chips are located or mounted. In another embodiment, the data driver 150 may be formed to include a plurality of driving chips, and may be located on a non-display region of the display panel 110 in a chip on glass (COG) manner.

The display device 100 may further include a power supply. The power supply may receive a direct-current (DC) power from an external component, and may generate a plurality of voltages suitable for operating the display device 100 based on the DC power. For example, the power supply may generate a scan driving voltage provided to the scan driver 140, a data driving voltage provided to the data driver 150, and a gamma generating voltage provided to the gamma voltage generator 130. For example, the scan driving voltage may include an on-gate voltage and an off-gate voltage, the data driving voltage may include an analog power voltage and a digital power voltage, and the gamma generating voltage may include a first reference voltage and a second reference gamma voltage.

As described above, the display device 100 may reduce noises of the gamma voltages V0 through V255, and may reduce power consumption of the display device 100 by calculating the minimum gamma tab voltage based on both of the upper reference gamma voltage and the lower reference gamma voltage, by outputting the bias control signals when the minimum gamma tab voltage is less than the reference voltage, and by differently controlling the output strengths of the gamma tab voltages based on the bias control signals.

Figure 2:
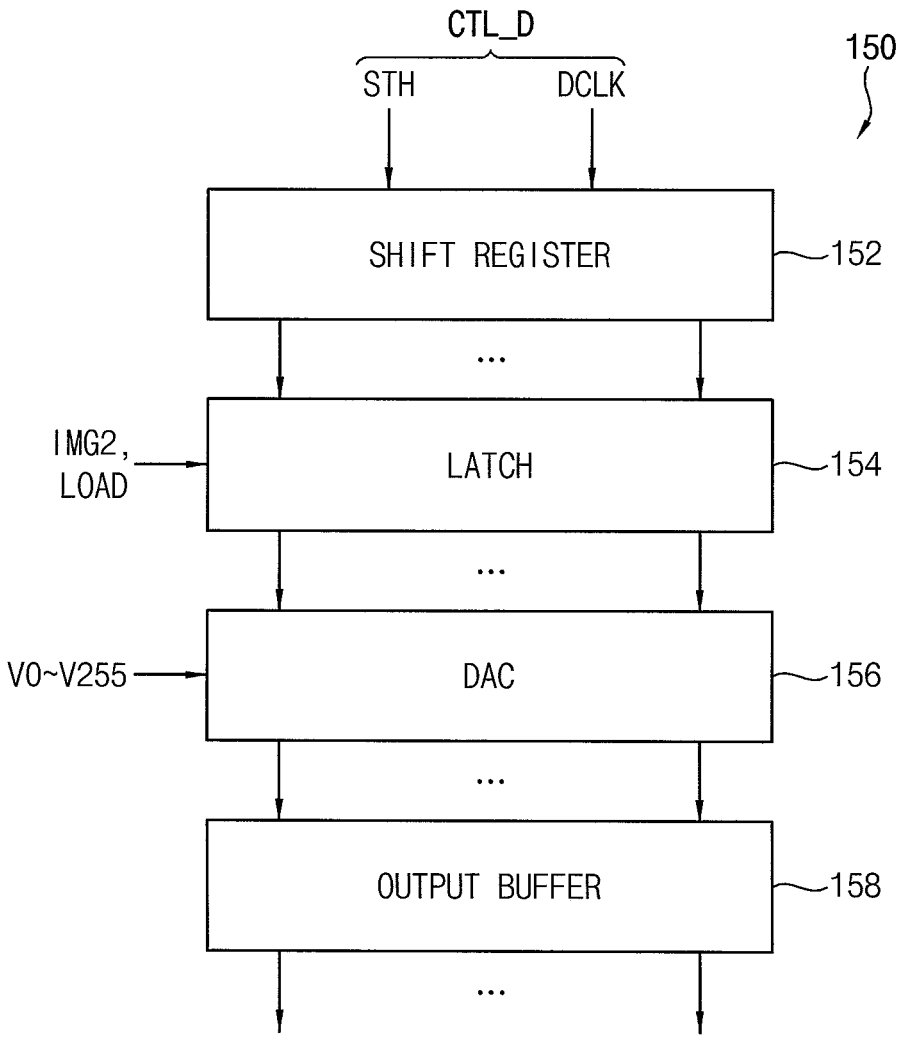
FIG. 2 is a block diagram illustrating an example of a data driver included in the display device of FIG. 1.

FIG. 2 is a block diagram illustrating an example of a data driver included in the display device of FIG. 1.

Referring to FIG. 2, the data driver 150 may include a shift register 152, a latch 154, a digital-to-analog converter (DAC) 156, and an output buffer 158.

The shift register 152 may receive the data control signal CTL_D from the timing controller 120. The data control signal CTL_D may include a horizontal start signal STH and a data clock signal DCLK. The shift register 152 may generate a sampling signal by shifting the horizontal start signal STH in synchronization with the data clock signal DCLK.

The latch 154 may latch the second image data IMG2 in response to the sampling signal. The latch 154 may output the latched second image data IMG2 in response to a load signal LOAD.

The digital-to-analog converter 156 may convert the latched second image data IMG2 into the data signal based on the gamma voltages V0 through V255. The digital-to-analog converter 156 may convert the input data that is in a digital form into the data signal that is in an analog form based on the gamma voltages V0 through V255 provided from the gamma voltage generator 130.

The output buffer 158 may output the data signal, which is output from the digital-to-analog converter 156, to the data lines.

Although the data driver 150 including the shift register 152, the latch 154, the digital-to-analog converter 156, and the output buffer 158 is illustrated in FIG. 2, the data driver 150 is not limited thereto. In other words, the data driver 150 may have various structures.

Figure 3:
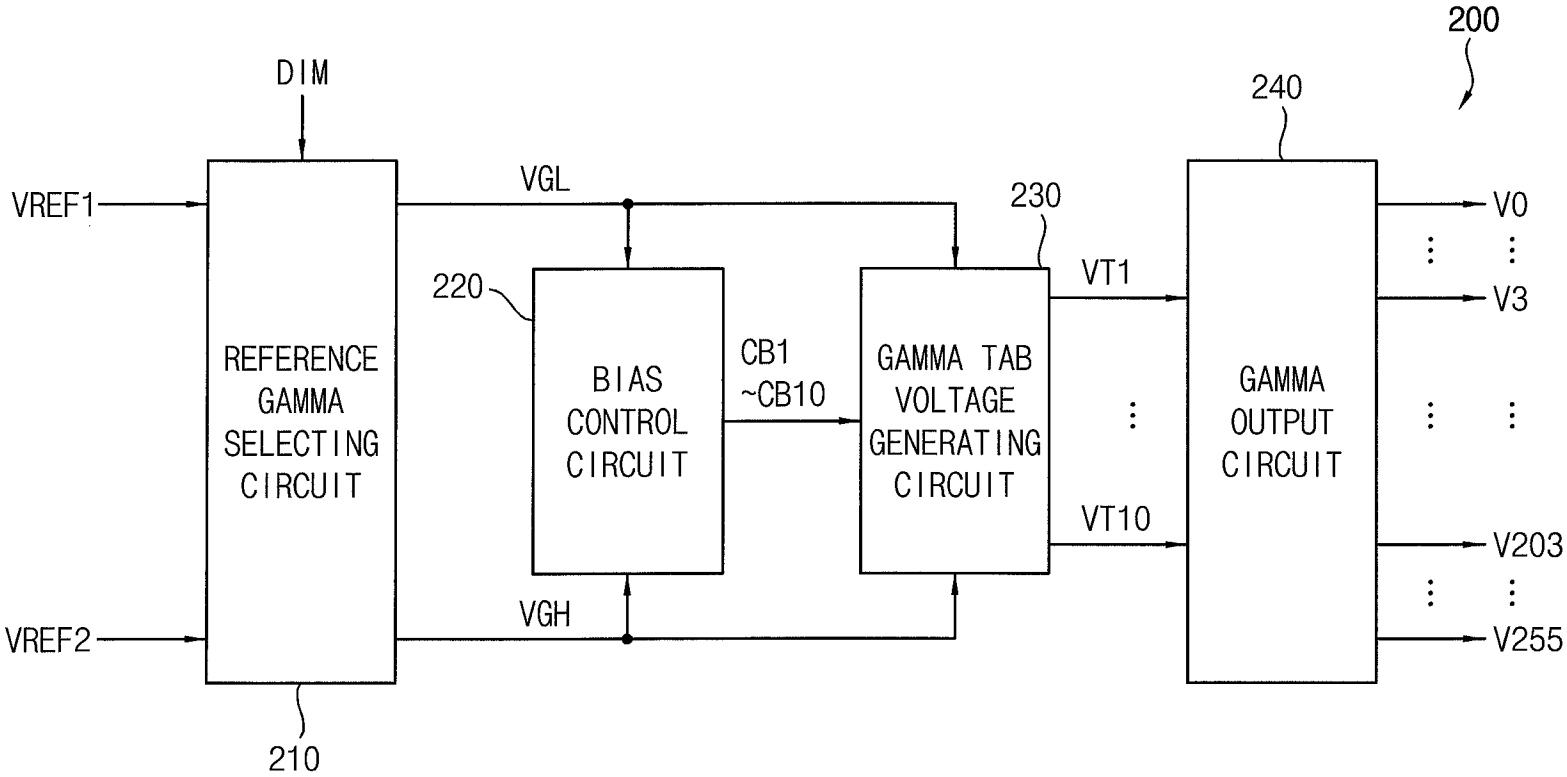
FIG. 3 is a block diagram illustrating an example of a gamma voltage generator included in the display device of FIG. 1.
Figure 4:
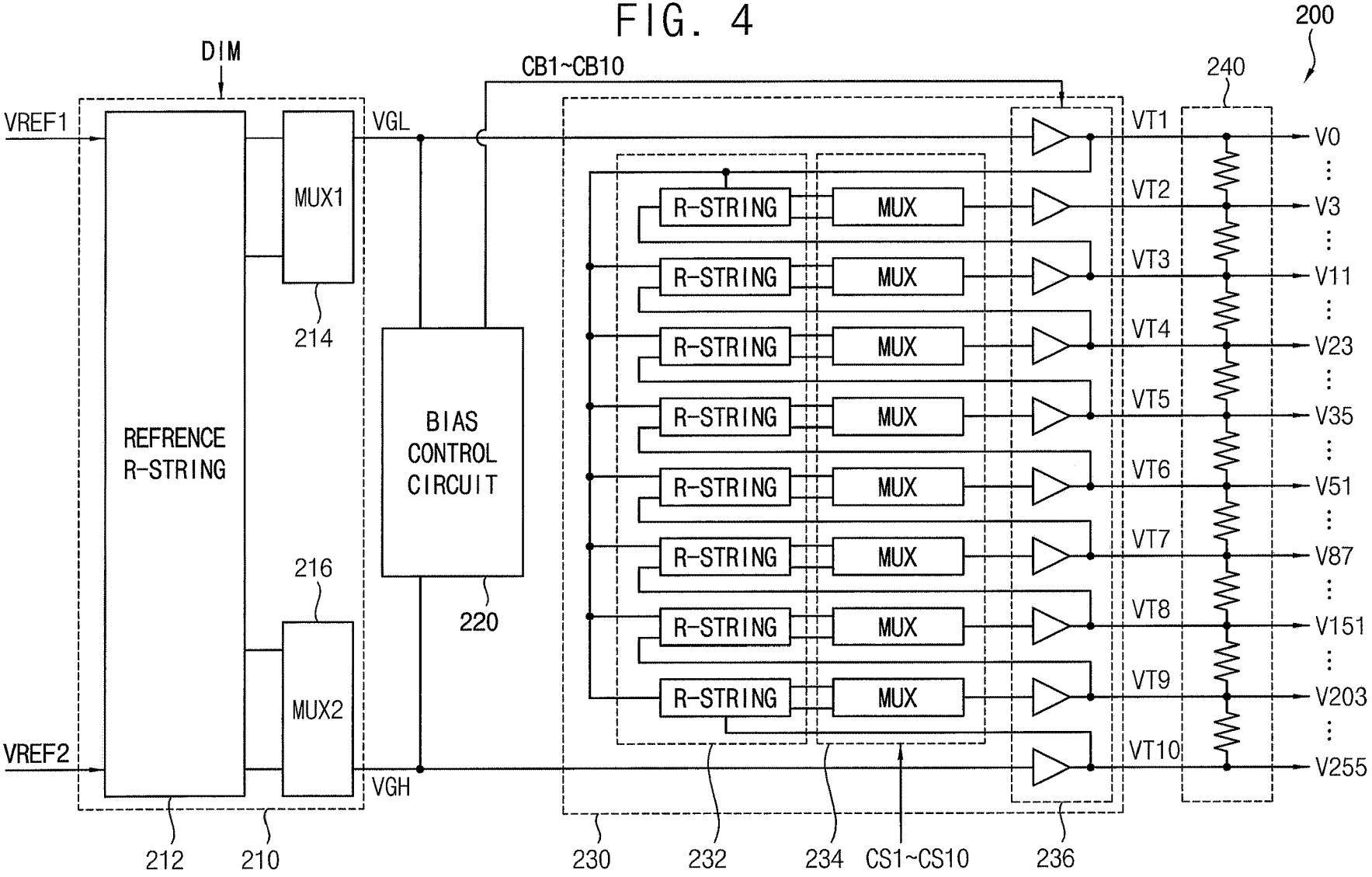
FIG. 4 is a block diagram illustrating another example of a gamma voltage generator included in the display device of FIG. 1.

FIG. 3 is a block diagram illustrating an example of a gamma voltage generator included in the display device of FIG. 1, and FIG. 4 is a block diagram illustrating another example of a gamma voltage generator included in the display device of FIG. 1.

Referring to FIGS. 3 and 4, the gamma voltage generator 200 may include a reference gamma selecting circuit 210, a bias control circuit 220, a gamma tab voltage generating circuit 230, and a gamma output circuit 240. The gamma voltage generator 200 illustrated in FIGS. 3 and 4 may correspond to the gamma voltage generator 200 of FIG. 1.

The reference gamma selecting circuit 210 may receive a first reference voltage VREF1 and a second reference voltage VREF2, and may select an upper reference gamma voltage VGH and a lower reference gamma voltage VGL based on a dimming level DIM, where the upper reference gamma voltage VGH corresponds to a maximum gamma tab voltage among voltages between the first reference voltage VREF1 and the second reference voltage VREF2, and where the lower reference gamma voltage VGL corresponds to a minimum gamma tab voltage among the voltages between the first reference voltage VREF1 and the second reference voltage VREF2. The upper reference gamma voltage VGH and the lower reference gamma voltage VGL may be voltages for generating an intermediate gamma voltage. For example, a minimum reference voltage may be a ground voltage. The reference gamma selecting circuit 210 may select a reference gamma voltage based on the dimming level DIM. In an embodiment, the reference gamma selecting circuit 210 may increase the upper reference gamma voltage VGH (e.g., may select the upper reference gamma voltage VGH having a higher voltage level) as the dimming level DIM increases.

In an embodiment, the reference gamma selecting circuit 210 may include a reference resistor-string 212, a first reference selector (MUX1) 214, and a second reference selector (MUX2) 216. The reference resistor-string 212 may distribute the first reference voltage VREF1 and the second reference voltage VREF2. The reference resistor-string 212 may include a plurality of resistors connected in series. The upper reference gamma voltage VGH and the lower reference gamma voltage VGL may be applied to both ends of the reference resistor-string 212. The voltages may be output at connection nodes between the resistors included in the reference resistor-string 212.

The first reference selector 214 may select one of distributed voltages that are generated by the reference resistor-string 212 as the lower reference gamma voltage VGL based on the dimming level DIM. In an embodiment, the first reference selector 214 may receive a plurality of voltages that are relatively close to the first reference voltage VREF1 from the reference resistor-string 212, and may select and output the lower reference gamma voltage VGL based on the dimming level DIM. In another embodiment, the first reference selector 214 may receive a plurality of voltages that are relatively close to the first reference voltage VREF1 from the reference resistor-string 212, and may select and output the lower reference gamma voltage VGL based on the upper reference gamma voltage VGH. For example, the first reference selector 214 may be a multiplexer that selects and outputs one of a plurality of input voltages.

The second reference selector 216 may select one of distributed voltages that are generated by the reference resistor-string 212 as the upper reference gamma voltage VGH based on the dimming level DIM. The second reference selector 216 may select the upper reference gamma voltage VGH having a higher voltage level as the dimming level DIM increases. In an embodiment, the second reference selector 216 may receive a plurality of voltages that are relatively close to the second reference voltage VREF2 from the reference resistor-string 212, and may select and output the upper reference gamma voltage VGH based on the dimming level DIM. For example, the second reference selector 216 may be a multiplexer that selects and outputs one of a plurality of input voltages.

The bias control circuit 220 may calculate the minimum gamma tab voltage based on the upper reference gamma voltage VGH and the lower reference gamma voltage VGL, and may output bias control signals CB1 through CB10 when the minimum gamma tab voltage is less than a reference voltage (e.g., a predetermined reference voltage). The bias control circuit 220 may receive the lower reference gamma voltage VGL output from the first reference selector 214, and may receive the upper reference gamma voltage VGH output from the second reference selector 216. The bias control circuit 220 may calculate the minimum gamma tab voltage (e.g., a first gamma tab voltage VT1) based on the upper reference gamma voltage VGH and the lower reference gamma voltage VGL. Here, the minimum gamma tab voltage may be a gamma tab voltage for outputting a minimum gamma voltage V0 corresponding to a minimum gray-level (e.g., the 0th gray-level). For example, the minimum gamma tab voltage may have the same voltage level as the lower reference gamma voltage VGL.

As illustrated in FIG. 4, the gamma tab voltage generating circuit 230 of the gamma voltage generator 200 has a cascade structure. A noise of the gamma tab voltage corresponding to a low gray-level gamma voltage (e.g., the 0th gray-level) may be increased (or dominant). For example, because a difference between the minimum gamma tab voltage and the maximum gamma tab voltage (e.g., the tenth gamma tab voltage VT10) for outputting the maximum gamma voltage V255 corresponding to the maximum gray-level (e.g., the 255th gray-level) increases when the voltage level of the minimum gamma tab voltage is low, a noise of the minimum gamma tab voltage may be amplified. For example, the maximum gamma tab voltage may have the same voltage level as the upper reference gamma voltage VGH. The bias control circuit 220 may output the bias control signals CB1 through CB10 that change the bias current for the gamma amplifiers 236 included in the gamma tab voltage generating circuit 230 when the minimum gamma tab voltage is less than the reference voltage. Thus, the noises of the gamma tab voltages VT1 through VT10 (e.g., noise corresponding to the gamma tab voltages VT1 through VT10) may be reduced.

The gamma tab voltage generating circuit 230 may generate a plurality of gamma tab voltages (e.g., the second gamma tab voltage VT2 through the ninth gamma tab voltage VT9) between the minimum gamma tab voltage (e.g., the first gamma tab voltage VT1) and the maximum gamma tab voltage (e.g., the tenth gamma tab voltage VT10) based on the upper reference gamma voltage VGH and the lower reference gamma voltage VGL. The gamma tab voltage generating circuit 230 may receive the lower reference gamma voltage VGL output from the first reference selector 214 and the upper reference gamma voltage VGH output from the second reference selector 216. The gamma tab voltage generating circuit 230 may distribute the upper reference gamma voltage VGH and the lower reference gamma voltage VGL, and may generate and output the gamma tab voltages VT1 through VT10 by selecting intermediate gamma voltages among the distributed voltages.

In an embodiment, the gamma tab voltage generating circuit 230 may include a plurality of resistor-strings 232, a plurality of gamma tap selectors 234, and a plurality of gamma amplifiers 236. The resistor-strings 232 may be connected in a cascade form to distribute the upper reference gamma voltage VGH and the lower reference gamma voltage VGL.

The gamma tap selectors 234 may select a portion of distributed voltages that are generated by the resistor-strings 232 as the gamma tab voltages VT1 through VT10 based on a plurality of gamma tap selection signals CS1 through CS10. For example, each of the gamma tap selectors 234 may be a multiplexer that selects one of a plurality of input voltages. In an embodiment, the gamma tap selection signals CS1 through CS10 may be selected by a user's input or by an external input. In another embodiment, the gamma tap selection signals CS1 through CS10 may be stored during a manufacturing process.

The gamma amplifiers 236 may output voltages selected by the gamma tap selectors 234 as the gamma tab voltages VT1 through VT10 based on the bias control signals CB1 through CB10. The gamma amplifiers 236 may have independent (or different) output strengths according to the bias control signals CB1 through CB10. The gamma tab voltage generating circuit 230 may control the output strength of one gamma amplifier 236, which outputs the gamma tab voltage corresponding to a lower gray-level among the gamma tab voltages VT1 through VT10, to be stronger than an output strength of another gamma amplifier 236, which outputs the gamma tab voltage corresponding to an upper gray-level among the gamma tab voltages VT1 through VT10, based on the bias control signals CB1 through CB10. For example, the gamma tab voltage generating circuit 230 may increase the output strength of the gamma amplifier 236 that outputs the first gamma tab voltage VT1 having relatively significant noise by increasing the bias current for the gamma amplifier 236 based on the first bias control signal CB1. In addition, the gamma tab voltage generating circuit 230 may decrease the output strength of one gamma amplifier 236, which outputs the tenth gamma tab voltage VT10 having a relatively small noise, by decreasing the bias current for the gamma amplifier 236 based on the tenth bias control signal CB10. Thus, power consumption of the gamma amplifier 236 that outputs the tenth gamma tab voltage VT10 may be reduced. Further, the gamma tab voltage generating circuit 230 may perform an interpolation on the output strengths of the gamma amplifiers 236. For example, the gamma tab voltage generating circuit 230 may determine the output strength of the gamma amplifier 236 that outputs the Jth gamma tab voltage VTJ, where J is greater than 1 and smaller than 10, by performing an interpolation between the output strength of the gamma amplifier 236 that outputs the first gamma tab voltage VT1 and the output strength of the gamma amplifier 236 that outputs the tenth gamma tab voltage VT10. Thus, the gamma tab voltage generating circuit 230 may gradually decrease the output strength in a direction from the gamma amplifier 236 that outputs the first gamma tab voltage VT1 to the gamma amplifier 236 that outputs the tenth gamma tab voltage VT10.

As illustrated in FIG. 4, the gamma tab voltage generating circuit 230 may have a cascade structure. The gamma tab voltage generating circuit 230 may include a plurality of stages. For example, the gamma tab voltage generating circuit 230 may include first through tenth stages that output the first through tenth gamma tab voltages VT1 through VT10, respectively. Referring to FIG. 4, the first stage may output the lower reference gamma voltage VGL as the first gamma tab voltage VT1. The first gamma tab voltage VT1 may correspond to the gamma voltage V0 of the 0th gray-level. The gamma amplifier 236 of the first stage may control the bias current based on the first bias control signal CB1.

The Kth stage that outputs the Kth gamma tab voltage VTK, where K is an integer between 2 and 9, may include the resistor-string 232, the gamma tap selector 234, and the gamma amplifier 236. The Kth stage may distribute the first gamma tab voltage VT1 and the (K+1)th gamma tab voltage VT(K+1) using the resistor-string 232, may select one of distributed voltages that are generated by the gamma tap selector 234, and may output the selected voltage as the Kth gamma tab voltage VTK using the gamma amplifier 236. For example, the second stage may distribute the first gamma tab voltage VT1 and the third gamma tab voltage VT3 using the resistor-string 232, may select one of distributed voltages that are generated by the gamma tap selector 234, and may output the selected voltage as the second gamma tab voltage VT2 using the gamma amplifier 236. The second gamma tab voltage VT2 may correspond to the gamma voltage V3 of the 3rd gray-level. Here, the bias currents for the gamma amplifiers 236 included in the second through ninth stages may be controlled or adjusted based on the second through ninth bias control signals CB2 through CB9, respectively. In an embodiment, the bias currents for the gamma amplifiers 236 included in the second through ninth stages may have the same value. In another embodiment, the bias currents for the gamma amplifiers 236 included in the second through ninth stages may have a different value. The tenth stage may output the upper reference gamma voltage VGH as the tenth gamma tab voltage VT10. The tenth gamma tab voltage VT10 may correspond to the gamma voltage V255 of the 255th gray-level. The bias current for the gamma amplifier 236 included in the tenth stage may be controlled based on the tenth bias control signal CB10.

The gamma output circuit 240 may distribute the gamma tab voltages VT1 through VT10 to output the gamma voltages V0 through V255 corresponding to a gamma curve. In an embodiment, the gamma output circuit 240 may generate the gamma voltages V0 through V255 by distributing the gamma tab voltages VT1 through VT10 using a resistor-string.

As described above, the gamma voltage generator 200 may calculate the minimum gamma tab voltage based on the upper reference gamma voltage VGH and the lower reference gamma voltage VGL, may output the bias control signals CB1 through CB10 when the minimum gamma tab voltage is less than the reference voltage (e.g., the predetermined reference voltage), and may differently control the output strengths of the gamma tab voltages VT1 through VT10 based on the bias control signals CB1 through CB10. Thus, the output strengths of the gamma tab voltages VT1 through VT10 may be different from each other. Here, the gamma voltage generator 200 may increase the output strength of the gamma amplifier 236 that outputs the gamma tab voltage corresponding to a low gray-level gamma voltage having a relatively large amount of noise by increasing the bias current for the gamma amplifier 236. Thus, the noise of the gamma tab voltage may be reduced. In addition, the gamma voltage generator 200 may decrease the output strength of the gamma amplifier 236 that outputs the gamma tab voltage corresponding to a high gray-level gamma voltage having a relatively small amount of noise by decreasing the bias current for the gamma amplifier 236. Thus, power consumption of the gamma amplifier 236 may be reduced.

Figure 5:
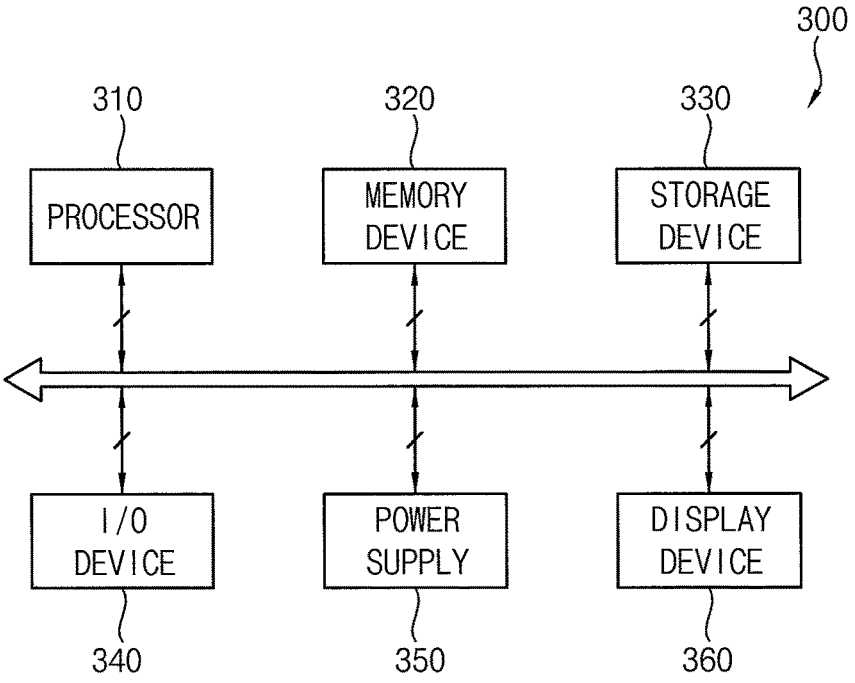
FIG. 5 is a block diagram illustrating an electronic device according to embodiments.
Figure 6:
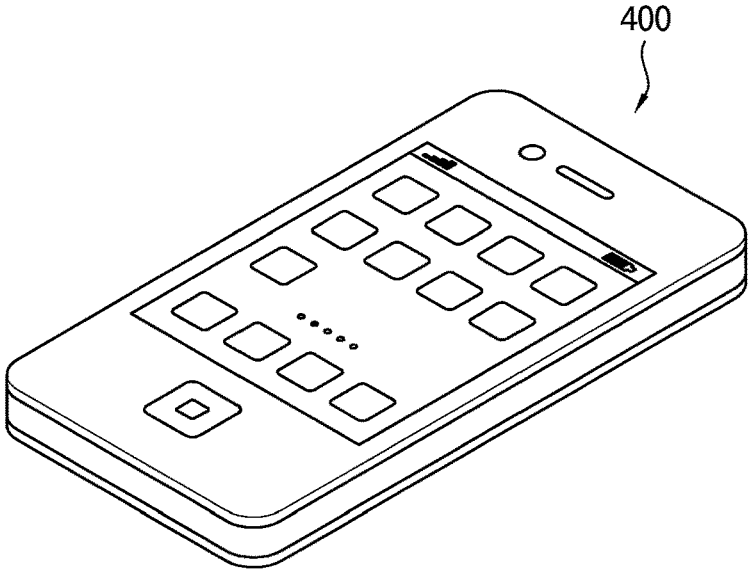
FIG. 6 is a diagram illustrating an example in which the electronic device of FIG. 5 is implemented as a smart phone.

FIG. 5 is a block diagram illustrating an electronic device according to embodiments, and FIG. 6 is a diagram illustrating an example in which the electronic device of FIG. 5 is implemented as a smart phone.

Referring to FIGS. 5 and 6, the electronic device 300 may include a processor 310, a memory device 320, a storage device 330, an input/output (I/O) device 340, a power supply 350, and a display device 360. Here, the display device 360 may be the display device 100 of FIG. 1. In addition, the electronic device 300 may further include a plurality of ports for communicating with a video card, a sound card, a memory card, a universal serial bus (USB) device, other electronic devices, etc. In an embodiment, as illustrated in FIG. 6, the electronic device 300 may be implemented as a smart phone 400. However, the electronic device 300 is not limited thereto.

The processor 310 may perform various computing functions. The processor 310 may be a microprocessor, a central processing unit (CPU), an application processor (AP), etc. The processor 310 may be coupled to other components via an address bus, a control bus, a data bus, etc. Further, the processor 310 may be coupled to an extended bus such as a peripheral component interconnection (PCI) bus. The memory device 320 may store data for operations of the electronic device 300. For example, the memory device 320 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 330 may include a solid state drive (SSD) device, a hard disk drive (HDD) device, a CD-ROM device, etc.

The I/O device 340 may include an input device such as a keyboard, a keypad, a mouse device, a touchpad, a touch-screen, etc., and an output device such as a printer, a speaker, etc. In some embodiments, the display device 360 may be included in the I/O device 340. The power supply 350 may provide power for operations of the electronic device 300. The display device 360 may be coupled to other components via the buses or other communication links. The display device 360 may include a display panel, a timing controller, a gamma voltage generator, a scan driver, and a data driver. The display panel may include a plurality of pixels. The display panel may include data lines and scan lines that are connected to the pixels. Each of the pixels may emit light based on a data signal provided via the data lines in response to a scan signal provided via the scan lines. The timing controller may receive first image data and a control signal from an external component. The timing controller may convert the first image data into second image data. The timing controller may generate a scan control signal and a data control signal for controlling a driving timing of the second image data based on a control signal. When changing a dimming level according to a user's input or an external input, the timing controller may provide a gamma control signal to the gamma voltage generator to change a gamma curve. The gamma voltage generator may receive a first reference voltage and a second reference voltage that is higher than the first reference voltage. Based on the gamma control signal (e.g., the dimming level), the gamma voltage generator may select an upper reference gamma voltage corresponding to a maximum gamma tab voltage among voltages between the first reference voltage and the second reference voltage and a lower reference gamma voltage corresponding to a minimum gamma tab voltage among the voltages between the first reference voltage and the second reference voltage. The gamma voltage generator may calculate the minimum gamma tab voltage based on the upper reference gamma voltage and the lower reference gamma voltage and may output bias control signals when the minimum gamma tab voltage is less than a reference voltage. The gamma voltage generator may generate a plurality of gamma tab voltages between the minimum gamma tab voltage and the maximum gamma tab voltage based on the upper reference gamma voltage and the lower reference gamma voltage. Here, the gamma voltage generator may control output strengths of the gamma tab voltages based on the bias control signals. The gamma voltage generator may include gamma amplifiers that control the output strengths of the gamma tab voltages based on the bias control signals, and each of the bias control signals may control a bias current of each of the gamma amplifiers. For example, the gamma voltage generator may reduce a noise of the gamma tab voltage by increasing the output strength of the gamma amplifier by increasing the bias current for the gamma amplifier that outputs the gamma tab voltage corresponding to a lower gray-level. In addition, the gamma voltage generator may reduce power consumption of the display device 360 by decreasing the output strength of the gamma amplifier by decreasing the bias current for the gamma amplifier that outputs the gamma tab voltage corresponding to an upper gray-level. The gamma voltage generator may output gamma voltages corresponding to a gamma curve by distributing the gamma tab voltages. The scan driver may generate a scan signal based on the scan control signal provided from the timing controller and may provide the scan signal to the scan lines in the display panel. The data driver may convert the second image data that is digital image data into analog image data using the gamma voltages provided from the gamma voltage generator and may generate the data signal based on the analog image data.

As described above, the display device 360 included in the electronic device 300 may reduce noise corresponding to the gamma voltages, and may reduce the power consumption by calculating the minimum gamma tab voltage based on the upper reference gamma voltage and the lower reference gamma voltage, by outputting the bias control signals when the minimum gamma tab voltage is less than the reference voltage, and by differently controlling the output strengths of the gamma tab voltages (e.g., making the output strengths of the gamma tab voltages be different from each other) based on the bias control signals. Because the display device 360 is described above, duplicated description related thereto will not be repeated.

Embodiments of the present disclosure may be applied to an electronic device including a display device. For example, embodiments of the present disclosure may be applied to a television, a computer monitor, a laptop, a digital camera, a cellular phone, a smart phone, a smart pad, a tablet PC, a personal digital assistant (PDA), a portable multimedia player (PMP), an MP3 player, a car navigation system, a video phone, a head mounted display (HMD) device, etc.

The foregoing is illustrative of embodiments and is not to be construed as limiting thereof. Although a few embodiments have been described, those skilled in the art will readily appreciate that many modifications are possible in the embodiments without materially departing from the novel teachings and aspects of embodiments of the present disclosure. Accordingly, all such modifications are intended to be included within the scope of the present disclosure as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims with functional equivalents thereof to be included therein.

What is claimed is:

1. A gamma voltage generator comprising:

a reference gamma selecting circuit configured to:

receive a first reference voltage, and a second reference voltage that is higher than the first reference voltage; and select an upper reference gamma voltage and a lower reference gamma voltage based on a dimming level, the upper reference gamma voltage corresponding to a maximum gamma tab voltage among voltages between the first reference voltage and the second reference voltage, and the lower reference gamma voltage corresponding to a minimum gamma tab voltage among the voltages between the first reference voltage and the second reference voltage;

a bias control circuit configured to:

calculate the minimum gamma tab voltage based on the upper reference gamma voltage and the lower reference gamma voltage; and output bias control signals when the minimum gamma tab voltage is less than a reference voltage;

a gamma tab voltage generating circuit configured to generate a plurality of gamma tab voltages between the minimum gamma tab voltage and the maximum gamma tab voltage based on the upper reference gamma voltage and the lower reference gamma voltage; and a gamma output circuit configured to distribute the gamma tab voltages to output gamma voltages corresponding to a gamma curve.

2. The gamma voltage generator of claim 1, wherein the gamma tab voltage generating circuit is configured to control output strengths of the gamma tab voltages based on the bias control signals.

3. The gamma voltage generator of claim 1, wherein the gamma tab voltage generating circuit is configured to differently control output strengths of the gamma tab voltages based on the bias control signals.

4. The gamma voltage generator of claim 1, wherein the gamma tab voltage generating circuit is configured to control an output strength of one of the gamma tab voltages corresponding to a lower gray-level to be stronger than an output strength of another one of the gamma tab voltages corresponding to an upper gray-level based on the bias control signals.

5. The gamma voltage generator of claim 1, wherein the gamma tab voltage generating circuit comprises:

a plurality of resistor-strings connected in a cascade form to distribute the upper reference gamma voltage and the lower reference gamma voltage;

a plurality of gamma tap selectors configured to select a portion of distributed voltages that are generated by the resistor-strings as the gamma tab voltages based on a plurality of gamma tap selection signals; and a plurality of gamma amplifiers configured to control output strengths of the gamma tab voltages based on the bias control signals.

6. The gamma voltage generator of claim 5, wherein the bias control signals are configured to respectively control a bias current for each of the gamma amplifiers.

7. The gamma voltage generator of claim 6, wherein the bias current for one of the gamma amplifiers that outputs the one of the gamma tab voltages corresponding to a lower gray-level is greater than the bias current for another one of the gamma amplifiers that outputs the other one of the gamma tab voltages corresponding to an upper gray-level among the gamma tab voltages.

8. The gamma voltage generator of claim 1, wherein the reference gamma selecting circuit comprises:

a reference resistor-string configured to distribute the first reference voltage and the second reference voltage;

a first reference selector configured to select one of distributed voltages generated by the reference resistor-string as the lower reference gamma voltage based on the dimming level; and a second reference selector configured to select one of the distributed voltages generated by the reference resistor-string as the upper reference gamma voltage based on the dimming level.

9. The gamma voltage generator of claim 1, wherein the reference gamma selecting circuit is configured to increase the upper reference gamma voltage as the dimming level increases.

10. A display device comprising:

a display panel comprising a plurality of pixels;

a gamma voltage generator configured to output a plurality of gamma voltages;

a data driver configured to generate a data signal based on the gamma voltages, and to provide the data signal to the pixels;

a scan driver configured to provide a scan signal to the pixels; and a timing controller configured to control the gamma voltage generator, the data driver, and the scan driver, wherein the gamma voltage generator comprises:

a reference gamma selecting circuit configured to receive a first reference voltage, and a second reference voltage that is higher than the first reference voltage, and to select an upper reference gamma voltage and a lower reference gamma voltage based on a dimming level, the upper reference gamma voltage corresponding to a maximum gamma tab voltage among voltages between the first reference voltage and the second reference voltage, and the lower reference gamma voltage corresponding to a minimum gamma tab voltage among the voltages between the first reference voltage and the second reference voltage;

a bias control circuit configured to calculate the minimum gamma tab voltage based on the upper reference gamma voltage and the lower reference gamma voltage, and to output bias control signals when the minimum gamma tab voltage is less than a reference voltage;

a gamma tab voltage generating circuit configured to generate a plurality of gamma tab voltages between the minimum gamma tab voltage and the maximum gamma tab voltage based on the upper reference gamma voltage and the lower reference gamma voltage; and a gamma output circuit configured to distribute the gamma tab voltages to output gamma voltages corresponding to a gamma curve.

11. The display device of claim 10, wherein the gamma tab voltage generating circuit is configured to control output strengths of the gamma tab voltages based on the bias control signals.

12. The display device of claim 10, wherein the gamma tab voltage generating circuit is configured to differently control output strengths of the gamma tab voltages based on the bias control signals.

13. The display device of claim 10, wherein the gamma tab voltage generating circuit is configured to control an output strength of the gamma tab voltage corresponding to a lower gray-level among the gamma tab voltages to be stronger than an output strength of the gamma tab voltage corresponding to an upper gray-level among the gamma tab voltages based on the bias control signals.

14. The display device of claim 10, wherein the gamma tab voltage generating circuit comprises:

a plurality of resistor-strings connected in a cascade form to distribute the upper reference gamma voltage and the lower reference gamma voltage;

a plurality of gamma tap selectors configured to select a portion of distributed voltages generated by the resistor-strings as the gamma tab voltages based on a plurality of gamma tap selection signals; and a plurality of gamma amplifiers configured to control output strengths of the gamma tab voltages based on the bias control signals.

15. The display device of claim 14, wherein each of the bias control signals is configured to control a bias current for each of the gamma amplifiers.

16. The display device of claim 15, wherein the bias current for one of the gamma amplifiers that outputs one of the gamma tab voltages corresponding to a lower gray-level is greater than the bias current for another one of the gamma amplifiers that outputs another one of the gamma tab voltages corresponding to an upper gray-level.

17. The display device of claim 10, wherein the reference gamma selecting circuit comprises:

a reference resistor-string configured to distribute the first reference voltage and the second reference voltage;

a first reference selector configured to select one of distributed voltages generated by the reference resistor-string as the lower reference gamma voltage based on the dimming level; and a second reference selector configured to select one of the distributed voltages generated by the reference resistor-string as the upper reference gamma voltage based on the dimming level.

18. The display device of claim 10, wherein the reference gamma selecting circuit is configured to increase the upper reference gamma voltage as the dimming level increases.

19. The display device of claim 10, wherein the gamma voltage generator is configured to generate red color gamma voltages, green color gamma voltages, and blue color gamma voltages, respectively.

20. The display device of claim 10, wherein the gamma voltage generator is connected to the data driver, or is comprised within the data driver.

* * * * *